US005454176A

United States Patent [19]

Gobel et al.

[11] Patent Number: 5,454,176

[45] Date of Patent: Oct. 3, 1995

[54] LARGE DIAMETER WAFER DRYER WITH ADJUSTABLE FLIGHTING

[75] Inventors: Richard J. Gobel, Scappoose, Oreg.; Daniel W. Thomas, Washougal, Wash.

[73] Assignee: Beloit Technologies, Inc., Wilmington, Del.

[21] Appl. No.: 146,674

[22] Filed: Nov. 1, 1993

[51] Int. Cl.[6] ..... F26B 11/02

[52] U.S. Cl. ..... 34/135; 432/118; 34/136; 34/182

[58] Field of Search ..... 34/135, 136, 130, 34/311, 359, 368, 369, 499, 586, 588, 576, 599, 179, 181, 182, 183, 609; 432/110, 118

[56] References Cited

U.S. PATENT DOCUMENTS

| | | | |
|---|---|---|---|
| 3,717,937 | 2/1973 | Thompson | 34/108 |
| 3,720,004 | 3/1973 | Okawora | 34/130 |
| 3,798,789 | 3/1974 | Thompson | 34/108 |
| 4,172,701 | 10/1979 | Bernt | 432/118 |
| 4,549,699 | 10/1985 | Thompson | 241/91 |
| 4,742,622 | 5/1988 | Thompson | 34/135 X |
| 4,860,462 | 8/1989 | Gobel | 34/108 |
| 4,964,226 | 10/1990 | Gobel | 34/136 |
| 5,083,382 | 1/1992 | Brashears | 34/135 |

FOREIGN PATENT DOCUMENTS

| | | | |
|---|---|---|---|
| 2470941 | 6/1981 | France . | |
| 0208281 | 3/1909 | Germany . | |
| 0242026 | 12/1911 | Germany . | |
| 0291136 | 4/1916 | Germany . | |
| 0864079 | 1/1953 | Germany . | |
| 1778116 | 7/1971 | Germany . | |
| 2119645 | 3/1973 | Germany . | |
| 1534257 | 1/1990 | U.S.S.R. | 34/368 |
| 0000252 | of 1878 | United Kingdom . | |
| 0333517 | 9/1930 | United Kingdom . | |
| 0825628 | 12/1959 | United Kingdom . | |
| 1168691 | 10/1969 | United Kingdom . | |
| 1493351 | 11/1977 | United Kingdom . | |

*Primary Examiner*—Henry A. Bennet
*Assistant Examiner*—William C. Doerrler
*Attorney, Agent, or Firm*—Dirk J. Veneman; Raymond W. Campbell

[57] ABSTRACT

A dryer for drying material carried along and dried by hot gases including a hollow rotatable drying drum with an inlet and a discharge end, means for driving the drum in rotation and a group of flights projecting into the gas flow stream to break up the material and retard the speed of flow of the material with the flowing gases with the flights arranged in one group at the outer periphery inside the drum and the other supported on a central axially extending core member arranged on the ends of arms projecting radially from the core member to provide satellite groups which are adjustable in a radial rotational and axial directions to change their location relative to the gas flow.

10 Claims, 2 Drawing Sheets

LARGE DIAMETER WAFER DRYER WITH ADJUSTABLE FLIGHTING

BACKGROUND OF THE INVENTION

The invention relates to improvements in drying mechanisms and more particularly to an improved very large rotary drying drum for drying products carried by hot gases through the drum.

The invention relates to hot gas drying wherein pieces of material to be dried such as wood chips, hog fuel and bagasse or strands pass through huge drums by hot drying gases wherein the moisture is evaporated from the material while it is carried through the drum. The drying drums are provided for many types of industries and the type of material to be dried and the amount of drying to be accomplished will dictate the drum size.

One type of dryer of this type is used in the pulp and paper and wood product industry as a rotary wafer dryer. These dryers are used to dry large pieces of material such as wood chips, hog fuel, bagasse or strand wafers which are dried before further processing. The dryers when used for wood chips handle materials which have a wide range in size, and the drum may be provided to dehydrate any form of material. The drum of these dryers is large, up to 18' in diameter or more and 20' to 80' in length. They are supported to rotate about their horizontal longitudinal axis and are supported on suitable rotatable supports and motor driven in rotation. The interior of these drums is provided with flights which help to distribute the material and prevent its too rapid passage axially through the drum.

One difficulty encountered with these large drums is that material tends to be carried too rapidly on the stream of gases through the drum. Also, the particles tend to agglomerate so that insufficient area exposure to the hot drying gases is obtained. Efficient heat exchange is promoted by creating a homogeneous shower or curtain of the material, to fill the entire cross section of the drum. Gas dispersion is promoted if the material is showered properly and the individual pieces of the material are liberated to fall a predetermined distance. Previous designs have been deficient in promoting these efficiencies, particularly with large materials of ten or twelve inches in length.

Dryers of this type frequently have multiple uses and must be adaptable to handling various sizes and amounts of material. Production in a given plant may vary as well. Accordingly, often different requirements are necessary for adequate dispersion of the material in the drum and particularly for adequate deterrence of the speed of travel. The particles of material being dried cannot be allowed to be swept on through the drum by the traveling gases or there will be insufficient particle drying occurring. If inadequate showering of material occurs hot streaks of gases penetrate the length of the dryer, which can result in damage to the material being dried.

The primary procedure to increase exposure of the materials to the gases is to rotate the drum so that the material is tumbled inside. Another mechanical expedient for increasing exposure of the particles to the gas is to place fins or other travel deterring projections into the gas stream so that the particles will impact the mechanical deterrents to impede the conveyance of the material by the gas stream. These, however, will not normally suffice for all types of material and the operator may not know the effectiveness of the deterrents until operation of the dryer is tried. The type of deterrent is not obvious particularly in view of the huge size of some of the dryer drums which must be provided for commercial drying purposes. The fins or projections are welded to the inner surface of the drum and to a central shaft extending axially through the drum. Once installed, the fins are not adjusted easily.

It is accordingly an object of the present invention to provide an improved dryer drum structure wherein particles of various sizes and shapes including pulverulent particles are dried by being carried by hot gases horizontally through a rotating dryer drum.

A further object of the invention is to provide improved deterrent means within the drum which will break up the materials and which will deter the rapid traveling of particles through the drum and insure improved exposure to hot drying gases.

A still further object of the invention is to provide an improved mechanical deterring means for particles carried by hot gases through a drying drum with an improved mechanical arrangement and improved adjustments to enhance the deterring effect and the dispersing effect.

FEATURES OF THE INVENTION

In accordance with the features of the invention, large rotary drying drums are provided mounted for rotation on a horizontally extending axis wherein material to be dried and heated gases are directed into an entry end of the drum and discharged from a discharge end. Within the drum are a plurality of uniquely arranged rods or finger flights which are arranged in one form of groups at the outer periphery of the rotating drum. A second grouping of finger flights is carried on a central core shaft extending axially through the drum. These finger flights are arranged in satellite groups with each satellite carrying a star of radially extending flights with each star mounted at the outer end of a radial arm carried on the central core shaft. The arms are situated so that the stars can be adjusted radially inwardly and outwardly and so that they can also be rotated about the axis of the supporting arm for rotational adjustment to optimum position. Further, the individual arms are movable axially along the central support shaft so that maximum effective adjustment can be attained for a great variety of materials. This maximum adjustment also provides for the most effective deterrence of the travel of the material.

Other objects, advantages and features, as well as equivalent structures which are to be covered herein, will become more clear with the teaching of the principles of the invention in connection with the disclosure of the preferred embodiments thereof in the specification, claims and drawings, in which:

DESCRIPTION OF THE PREFERRED EMBODIMENTS

Figure 1:
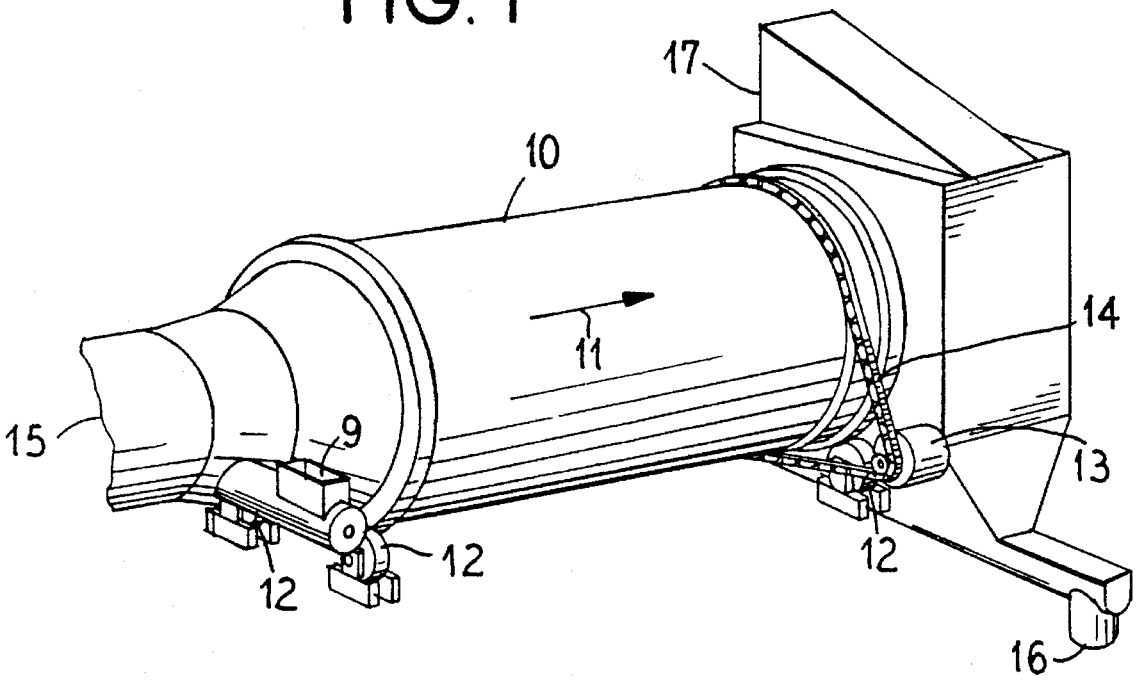
FIG. 1 is a perspective view of a drying drum constructed and operating in accordance with the principles of the present invention.

FIG. 1 illustrates a rotatable horizontal dryer drum 10 which may be of various sizes, depending upon the type of material to be dried. In commercial use, such drum may be on the order of 18 feet in diameter and 40 feet to 70 feet long. The sizes stated herein are only by way of example and other sizes may be utilized without departing from the present invention.

The drum is horizontally disposed and adapted for rotation on supporting rollers 12. The drum is driven in rotation by a driving motor 13 driving a chain 14 looped around the drum. In this way, the drum is driven in rotation so that material within the drum will be lifted and showered for better exposure to drying gases passing axially through the drum.

Hot drying gases are introduced at an entry end 15 of the drum to pass through the drum. Gases are drawn to the drum such as by a suction fan, not shown, to be drawn at 17, and the dried material will pass out of the drum through a conduit 16. The gases will pass in the direction indicated by the arrowed line 11 and material can be deposited into the drum at a material entry 9, to be picked up and transported with the traveling gases. If the material is not particulated and showered within the drum, sufficient exposure to the hot drying gases will not occur. Also, the material must not be permitted to be carried along on the gases without being broken up or to travel through the drum too rapidly so that sufficient time is not allowed for evaporation of the moisture and drying of the material.

Figure 2:
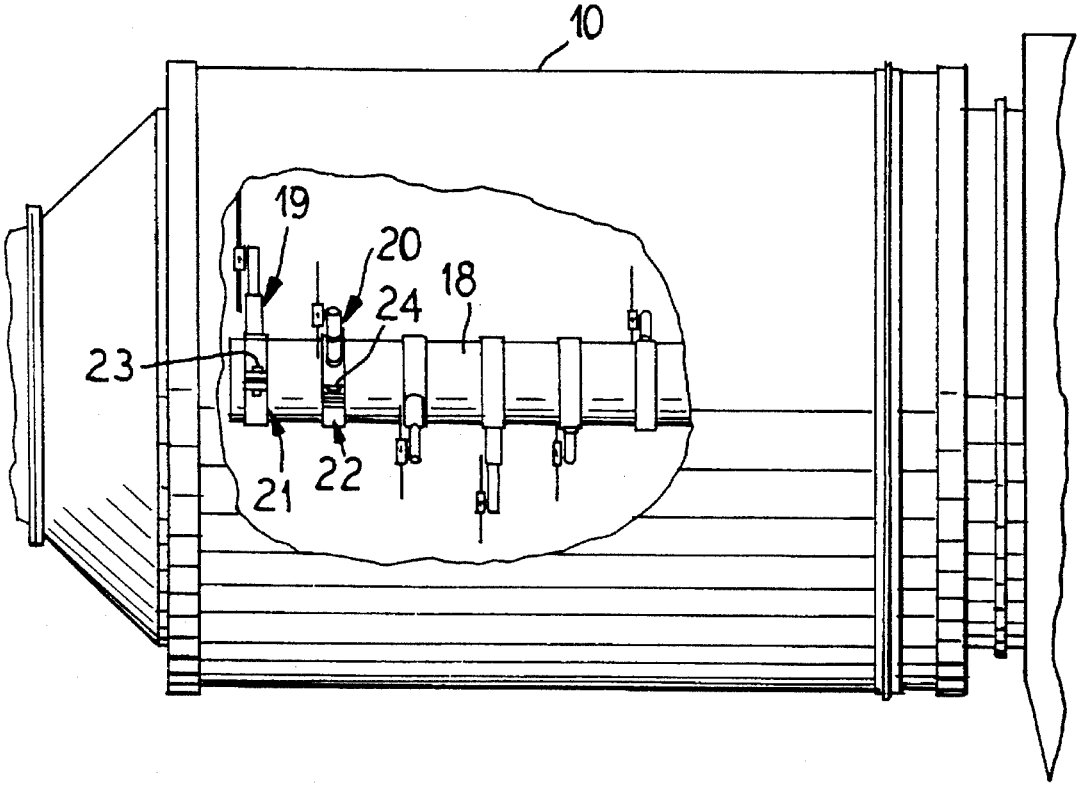
FIG. 2 is an elevational view of the drum with a side wall broken away to illustrate the interior construction within the drum.

As shown in FIG. 2, which illustrates a portion of the interior of the drum, extending axially through the drum, in the center thereof, is a supporting shaft 18. At axially spaced locations, the supporting shaft carries arms such as 19 and 20 which carry at their outer ends star arranged, finger-like flights shown at 27 and 28. These flights are in the form of metal rods projecting radially from a support center 31 or 32 to project into the stream of flowing gases. As illustrated, the centers 31 and 32 are positioned at the ends of arms 19 and 20, the arms extending radially outwardly from the supporting shaft 18 and the centers being essentially parallel to and spaced from the supporting shaft.

Figure 4:
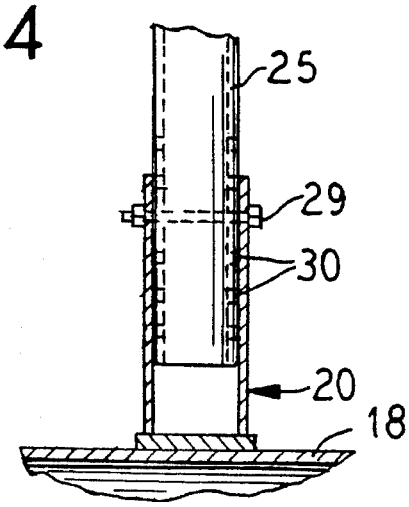
FIG. 4 is a fragmentary view showing the support for the satellite arranged flights which break up the material and deter its speed of travel through the drum.

The individual arms 19 and 20 are arranged with telescopic portions so that the distal end portions thereof, with the centers 31 and 32 and the finger flights attached thereto, can be moved radially inwardly and outwardly relative to the center shaft 18. For this purpose, the base of the arm 20, as shown in FIG. 4, is hollow and receives an outer telescoping part 25 of the arm. The base and telescoping part have holes which can be aligned to receive bolts 29 to lock the arm in adjusted position. The arms may additionally have holes in either the base portion or the extension portion arranged circumferentially so that the outer part 25 of the arm can be rotated thereby adjusting both the radial position of the satellite arms and their rotational position. When so adjusted, the centers 31 and 32 may or may not be parallel to the shaft 18.

A further adjustment is possible by the arms being supported on ring clamps shown at 21 and 22 in FIG. 2. These ring clamps are drawn tightly around the shaft 18, in adjusted position, by bolts 23 and 24 which pass through the split ends of the ring clamps. Thus, the ring clamps can be moved rotationally on the center shafts 18 to change the rotational location of the satellite stars, and they also can be moved axially to change their axial location on the center shaft.

Figure 3:
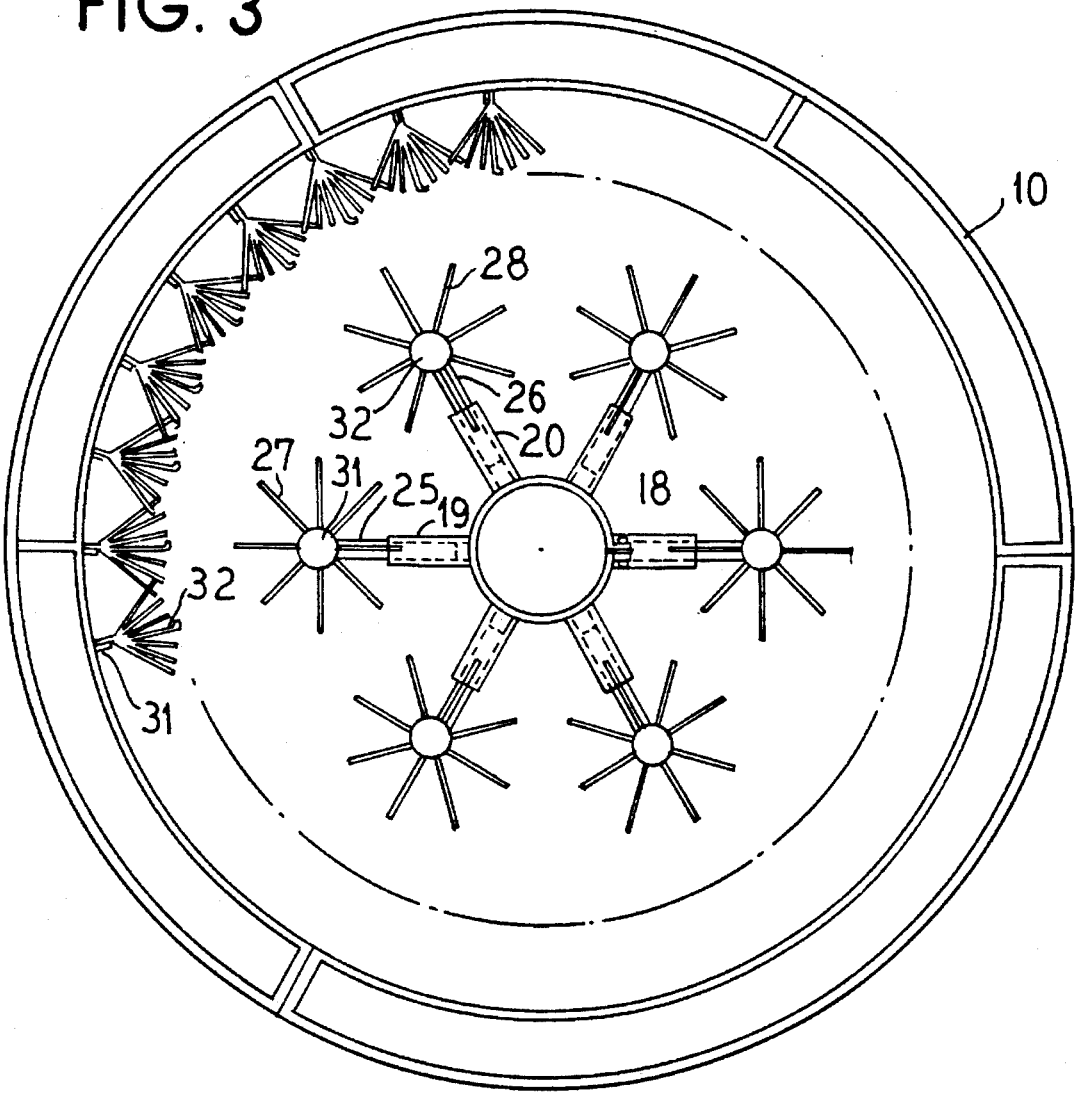
FIG. 3 is a vertical sectional view taken through the drum.

In addition to the satellite stars arranged uniformly around the center core shaft 18, further groups of flights are supported on the inner surface of the wall of the drum 10. As shown in FIG. 3, the groupings of flights 33 project outwardly from a supporting base 34 with a plurality of groups spaced circumferentially and spaced axially along the inner wall of the drum 10.

In operation, material to be dried is introduced to the drum at inlet 9, as shown in FIG. 1, and hot gases are introduced into the drum at the entry end 15. The material is entrained by the traveling hot gases and passes axially in the direction of the arrowed line 11 to the discharge end. The dried material is discharged at 16 and the gases are evacuated at 17. In some processes some or all of the gases may be recycled. In other applications, the material and gases are evacuated together to a cyclone separation device, where the material is separated.

While the material is passing through the drum by means of lifting and showering as the gas pushes or moves the material each time, the material stream is broken up and its speed of travel is deterred so that the material does not move at the speed of the gases. The interruption and deterrence is created by centrally located satellite arrangements of flights such as 27 and 28. Adjustment of these flights is possible in a radial direction, in a rotational direction, and in an axial direction with respect to the direction of flow. Additional flights such as 33 are provided along the periphery on the inner surface of the drum to lift and shower the material and drop it back into the stream of flowing gases.

If conditions of the material change, or if other materials are dried and the desired homogenous showering of material across the cross section of the drum is not achieved, the finger flights can be adjusted axially, radially or rotationally to achieve the desired results.

Thus, it will be seen that there has been provided an improved apparatus for dispersing and retarding the flow of material passing through a drying drum which conducts hot gases for the drying operation. A substantial latitude of adjustment is possible for improved drying operation and particularly for improved efficiency to enhance heat transfer from the gases to the material for improved drying operation.

We claim as our invention:

1. A dryer for drying material carried along and dried by hot gases comprising in combination:

an elongate tubular hollow drying drum having an inlet end and a discharge end, with a material inlet and a gas inlet located at the inlet end and a material outlet and a gas outlet located at the discharge end;

means for driving the drum in rotation for exposure of material within the drum to a gas stream of hot traveling gases flowing from the inlet end to the discharge end, said material being conveyed by the gas stream of flowing gases;

a plurality of adjustable flights extending into the gas stream, the flights impeding the traveling of the drying material and dispersing the material in the gas stream;

center shaft extending axially through the drum and supporting the flights:

and means adjustably supporting said flights in the drum;

wherein the support means provides for adjustment of the radial, axial and rotational positions of said flights relative to said center shaft.

2. A dryer for drying material carried along and dried by hot gases; comprising in combination:

an elongate tubular hollow drying drum having an inlet end and a discharge end, with a material inlet and a gas inlet located at the inlet end and a material outlet and a gas outlet located at the discharge end:

means for driving the drum in rotation for exposure of material within the drum to a gas stream of hot traveling gases flowing from the inlet end to the discharge end, said material being conveyed by the gas stream of flowing gases;

a plurality of adjustable flights extending into the gas stream, the flights impeding the traveling of the drying material and dispersing the material in the gas stream;

and means adjustably supporting said flights in the drum:

wherein said support means provides for adjustment of radial, axial and rotational position of flights relative to the axis of the drum.

3. A dryer for drying material carried along and dried by hot gases comprising in combination:

an elongate tubular hollow drying drum having an inlet end and a discharge end, with a material inlet and a gas inlet located at the inlet end and a material outlet and a gas outlet located at the discharge end;

means for driving the drum in rotation for exposure of material within the drum to a gas stream of hot traveling gases flowing from the inlet end to the discharge end, said material being conveyed by the gas stream of flowing gases;

a plurality of adjustable flights extending into the gas stream, the flights impeding the traveling of the drying material and dispersing the material in the gas stream;

and means adjustably supporting said flights in the drum;

wherein said supporting means includes a center shaft extending axially through said drum, and said flights are arranged in groups to form satellite groups positioned radially outwardly from said center shaft, said groups being connected to and adjustable axially along said center shaft.

4. A dryer for drying material carried along and dried by hot gases constructed comprising in combination:

an elongate tubular hollow drying drum having an inlet end and a discharge end, with a material inlet and a gas inlet located at the inlet end and a material outlet and a gas outlet located at the discharge end;

means for driving the drum in rotation for exposure of material within the drum to a gas stream of hot traveling gases flowing from the inlet end to the discharge end, said material being conveyed by the gas stream of flowing gases;

a plurality of adjustable flights extending into the gas stream, the flights impeding the traveling of the drying material and dispersing the material in the gas stream;

a center shaft extending axially through the drum and supporting the flights;

and means adjustably supporting said flights in the drum;

including a plurality of radial arms extending outwardly from said center shaft, the axial positions of said radial arms along said center shaft being adjustable, and each radial arm carrying a plurality of flights arranged in a group.

5. A dryer for drying material carried along and dried by hot gases constructed in accordance with claim 4:

wherein each group is rotationally adjustable about the axis of the arm,

6. A dryer for drying material carried along and dried by hot gases constructed in accordance with claim 4:

wherein each group is adjustable in a radial direction relative to said center shaft so as to project a controllable varied distance from the center shaft into the gas stream.

7. A dryer for drying material carried along and dried by hot gases constructed in accordance with claim 4:

wherein the radial arms permit a tilt adjustment of the groups to change the attitude of the groups of flights relative to the axial flow of the gas stream.

8. A dryer for drying material carried along and dried by hot gases comprising in combination:

an elongate tubular hollow drying drum having an inlet end and a discharge end;

means for driving the drum in rotation for exposure of material within the drum to hot traveling gases flowing from the inlet end to the discharge end and carrying said material with the flowing gases;

a plurality of first individual groups of flights mounted on the outer periphery of the drum and projecting into the stream of gas flow for breaking up the material and retarding the speed of travel through the drum;

a central axially extending support core extending through the drum;

a plurality of radial arms extending from the central core;

a second group of flights arranged in a plurality of groups each at the distal end of the radial arm;

and a shaft supporting each group of flights on the radial arm and rotationally adjustable, said shaft also being axially adjustable.

9. A dryer for drying material carried along and dried by hot gases constructed in accordance with claim 8:

wherein the radial arms are adjustable on the center core in a rotational and in an axial direction.

10. A dryer for drying material carried along and dried by hot gases comprising in combination:

an elongate tubular hollow drying drum having an inlet end and a discharge end;

means for driving the drum in rotation for exposure of material within the drum to hot traveling gases flowing from the inlet end to the discharge end and carrying said material with the flowing gases;

an axially extending central core in the rotary drum being centrally located;

a plurality of radially extending arms on the core with said arms being adjustable on the core in an axial and in a rotational direction;

and a radially slidable arm extension for each arm supporting at its distal end a satellite group of flights projecting into the stream of gas flow for retarding the speed of flow of material through the drum and for breaking up the material.

* * * * *